US005874922A

United States Patent [19]

Tanaka

[11] Patent Number: 5,874,922

[45] Date of Patent: Feb. 23, 1999

[54] ANTENNA

[75] Inventor: Nobuaki Tanaka, Nagaokakyo, Japan

[73] Assignee: Murata Manufacturing Co. Ltd, Kyojo, Japan

[21] Appl. No.: 815,278

[22] Filed: Mar. 10, 1997

[30] Foreign Application Priority Data

Jul. 2, 1996 [JP] Japan ..... 8-172506

[51] Int. Cl.[6] ..... H01Q 13/10; H01Q 19/06

[52] U.S. Cl. ..... 343/753; 343/770; 333/219; 333/219.1

[58] Field of Search ..... 343/753, 785, 343/767, 770, 700; 333/219, 219.1, 237, 238, 239, 248, 157; H01Q 13/10, 19/06

[56] References Cited

U.S. PATENT DOCUMENTS 5,666,094 9/1997 Kato et al. ..... 333/248

5,770,989 6/1998 Ishikawa et al. ..... 333/248

*Primary Examiner*—Hoanganh Le

*Attorney, Agent, or Firm*—Ostrolenk, Faber, Gerb & Soffen, LLP

[57] ABSTRACT

An antenna having a high gain, of small-size, and capable of setting the radiation direction of electromagnetic waves in a desired direction. The antenna also allows electromagnetic waves to be radiated stably. The antenna has a first planar conductor shaped like a flat plate. Disposed on the first planar conductor is a bar-shaped dielectric strip having one end connected to a waveguide or a transmission circuit and the other end being an open end which does not reach the position of openings in a second covering planar conductor. The end surface of the open end of the dielectric strip is shaped like a flat surface, and a column-shaped dielectric resonator is disposed at the open end side on the extension axis of the dielectric strip. A surrounding member is provided around the side of the dielectric resonator so as to surround it with a space therebetween. Further, a second planar conductor is disposed so as to cover the top surfaces of the dielectric strip, the dielectric resonator and the surrounding member. The second planar conductor has two rectangular-shaped openings above the dielectric resonator so as to be parallel to the extension axis along the length direction of the dielectric strip and to a line symmetry of the strip.

17 Claims, 7 Drawing Sheets

ANTENNA

BACKGROUND OF THE INVENTION

1. Field of the Invention

The present invention relates to an antenna and, more particularly, to an NRD guide (nonradiative dielectric waveguide) antenna in the millimeter-wave band used for collision prevention apparatus of automobiles, and the like.

2. Description of the Related Art

Antennas used in a conventional millimeter-wave band NRD guide and shown in FIGS. 8 and 9. Shown in FIG. 8 are planar conductors 71 and 72. A dielectric strip 73 is interposed between the conductors 71 and 72, forming an NRD guide. Further, one end of the NRD guide is connected to a transmit-receive circuit (not shown), and the dielectric strip 73 projects from between the conductors 71 and 72, thus forming an antenna 74. The antenna 74 constructed in this way radiates electromagnetic waves along the direction of the length of the dielectric strip 73.

Shown in FIG. 9 is a dielectric strip 81. Planar conductors 83 and 84 are mounted on the top surface and under surface of the dielectric strip 81, respectively, thus forming an NRD guide. Notches 81*a* through which electromagnetic waves radiate are formed along the horizontal direction (along the X-axis direction in FIG. 9) of the dielectric strip 81. A coaxial line 82 for supplying power is mounted on the side of one end portion of the dielectric strip 81. Further, a plurality of openings 85 are formed in the conductor 83 on the top surface in such a manner as to be parallel to the direction of the length (along the Y-axis direction in FIG. 9) of the dielectric strip 81, thus forming a plane antenna 86.

From the plane antenna 86 constructed as described above, electromagnetic waves are radiated from the dielectric strip 81 in the horizontal direction (in the X-axis direction in FIG. 9), and when openings 85 are formed in the conductor 83 at intervals of one wavelength thereof, electromagnetic waves are radiated via the openings 85 in the vertical direction (in the Z-axis direction in FIG. 9) of the plane antenna 86.

However, in the above-described conventional antenna 74, the radiation direction of electromagnetic waves is only in the direction of the length of the dielectric strip 73. Therefore, if the antenna 74 is used in a collision prevention apparatus of an automobile and mounted in such a way that the radiation direction of electromagnetic waves is directed in the moving direction of the automobile, the antenna 74 is disposed parallel to the moving direction of the automobile, and the sides of the conductors 71 and 72 of the antenna 74 project, for example, into the engine compartment. Thus, the mounting position of the antenna 74 is limited.

Further, since the plane antenna 86 is used in the millimeter-wave band, machining of the notches 81*a* formed in the dielectric strip 81 and the openings 85 of the conductor 83 requires high precision. Also, since a plurality of openings 85 are required, the surface areas of the conductors 83 and 84 become wide, and the conductors 83 and 84 flex due to insufficient strength of the conductors 83 and 84, causing variations in the antenna characteristics.

Furthermore, the gain of the antenna 74 depends upon the length of the dielectric strip 73. When the amount of loss in the dielectric strip 73 is taken into consideration, only 20% to 50% can be obtained as the antenna efficiency. If it is desired to increase gain in the plane antenna 86, its shape becomes enlarged.

SUMMARY OF THE INVENTION

The present invention has been achieved to solve the above-described problems. It is an object of the present invention to provide an antenna which has a high gain, is small-sized, and is capable of setting the radiation direction of electromagnetic waves in a desired direction as well as from which electromagnetic waves are radiated stably.

To achieve the above-described and other objects, according to one aspect of the present invention, there is provided an antenna comprising: a first planar conductor; a dielectric strip disposed on the first planar conductor; at least one dielectric resonator disposed on the first planar conductor on an axis of extension of the dielectric strip, the dielectric resonator being spaced from an end of the dielectric strip; a surrounding member disposed on the first planar conductor surrounding the dielectric resonator, a space being disposed between the surrounding member and the dielectric resonator; and a second planar conductor covering the dielectric strip, the dielectric resonator and the surrounding member and having at least one opening at a portion positioned in the vicinity of the at least one dielectric resonator.

According to another aspect of the present invention, when the wavelength of electromagnetic waves radiated from the dielectric resonator is denoted as $\lambda$, the surrounding member is disposed on the first planar conductor with a space of substantially $\{(2n+1)/4\}\times\lambda$ from the central portion of the dielectric resonator in the direction substantially intersecting at right angles to the direction in which the dielectric strip is disposed.

According to a further aspect of the present invention, a dielectric lens is disposed above the openings of the second planar conductor.

With the above-described construction, electromagnetic waves transmitted to the dielectric strip are electromagnetically coupled to the dielectric resonator, and the dielectric resonator resonates, causing the electromagnetic waves to radiate from the dielectric resonator mainly in the vertical direction of the antenna.

At this time, inside of the dielectric resonator, an electromagnetic field, which exhibits a symmetry between the upper and lower halves, having electric-field components parallel to the first and second planar conductors is present. However, this symmetry between the upper and lower halves of the electromagnetic waves deteriorates due to the influence of the openings provided in the second planar conductor, and an electromagnetic field having electric-field components vertical to the first and second planar conductors as main components comes to be intermixed with the above electromagnetic field. Due to the presence of this electromagnetic field having vertical electric-field components, a very small amount of electromagnetic waves are radiated from the side of the dielectric resonator in a direction substantially intersecting at right angles to the direction in which the dielectric strip is disposed.

If this very small amount of electromagnetic waves leak outside the antenna, there is a possibility that other external electronic parts might be affected. However, the surrounding member which surrounds the side of the dielectric resonator prevents very small amounts of electromagnetic waves from leaking outside, and thus no influence of leakage is exerted upon other external electronic parts and the like.

Further, by disposing the dielectric resonator and the surrounding member in such a manner as to satisfy the equation expressed by $\{(2n+1)/4\}\times\lambda$, a very small amount of electromagnetic waves radiated from the side of the dielectric resonator are reflected by the surrounding member and coupled to the electromagnetic waves radiated from the openings above the dielectric resonator, and thus more strongly radiated electromagnetic waves can be obtained.

Furthermore, by disposing a dielectric lens above the openings provided in the second planar conductor, an antenna having a higher gain can be obtained.

The above and further objects, aspects and novel features of the invention will become more apparent from the following detailed description when read in connection with the accompanying drawings.

DETAILED DESCRIPTION OF EMBODIMENTS OF THE INVENTION

The preferred embodiments of the present invention will be described below in detail with reference to the accompanying drawings.

Figure 1A:
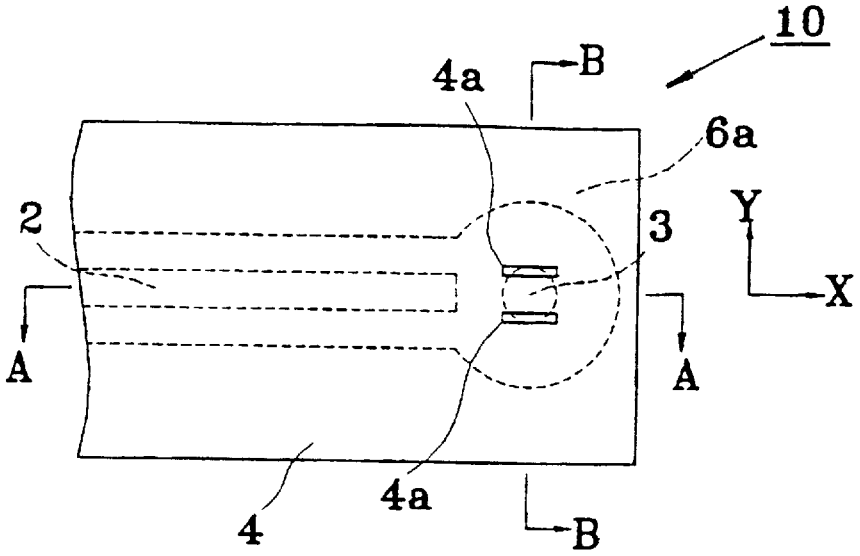
FIG. 1A is a plan view illustrating the structure of an antenna in accordance with a first embodiment of the present invention.
Figure 1B:
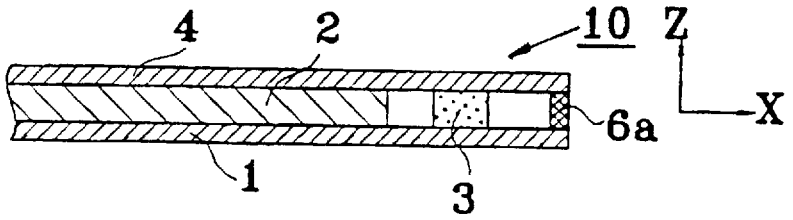
FIG. 1B is a sectional view taken along the line A—A in Fig. 1A.
Figure 2:
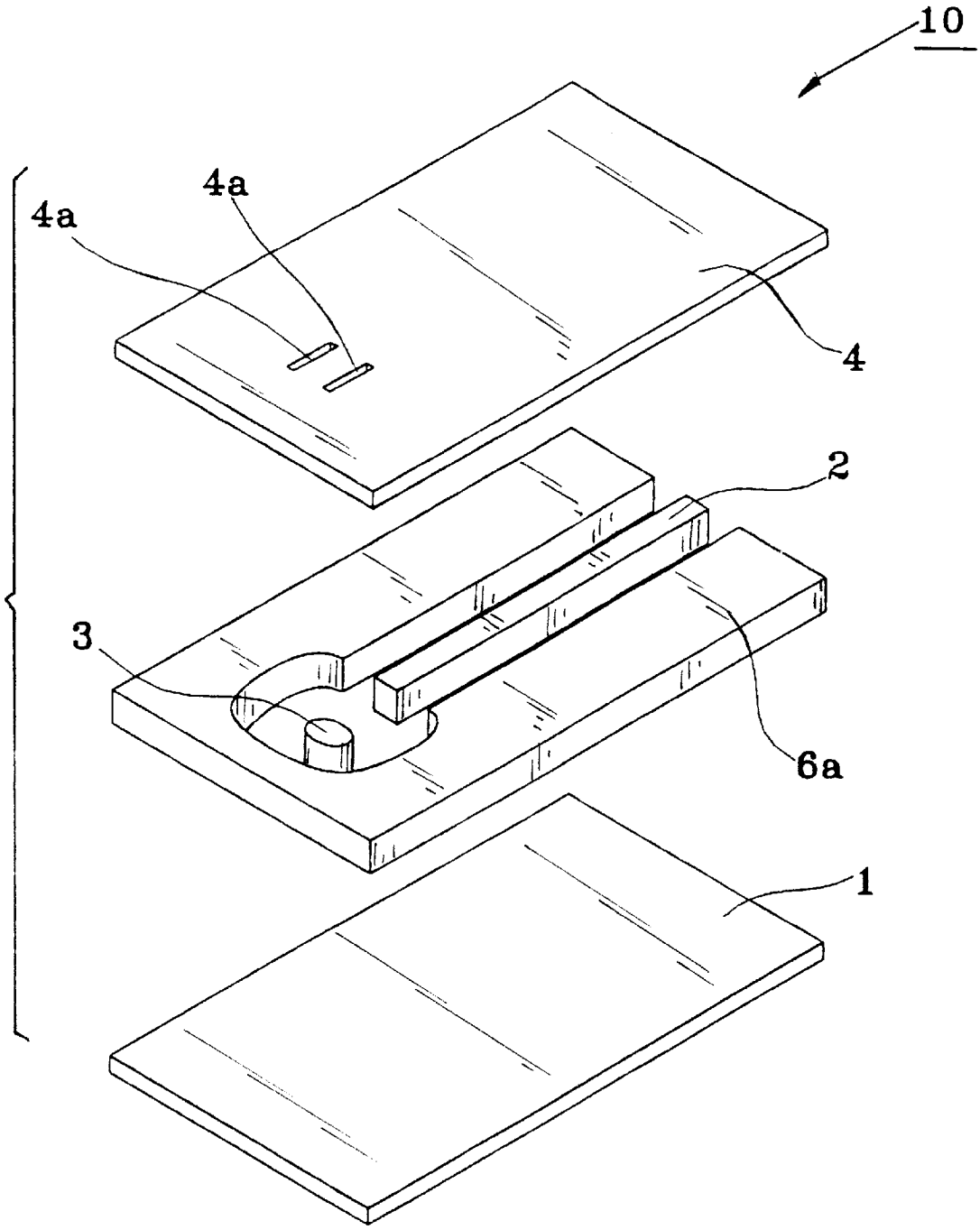
FIG. 2 is an exploded, perspective view illustrating the structure of the antenna in accordance with the first embodiment of the present invention.

FIGS. 1A, 1B, and 2 show an antenna 10 in accordance with a first embodiment of the present invention. FIG. 1A is a partial plan view of the antenna 10. FIG. 1B is a sectional view taken along the line A—A in FIG. 1A. FIG. 2 is an exploded, perspective view thereof. Reference numeral 1 denotes a first planar conductor in the shape of a flat plate made from aluminum or another conductor. Disposed on the top surface of the first planar conductor 1 is a bar-shaped dielectric strip 2 having one end connected to a waveguide or a transmission circuit (not shown) and the other end being an open end which does not reach the position of openings 4*a* to be described later. The open end of the dielectric strip 2 is shaped like a flat surface, and a column-shaped dielectric resonator 3 is disposed at the open end side on the axis of extension of the dielectric strip 2. A surrounding member 6*a* is provided around the side of the dielectric resonator 3 so as to surround it with a space therebetween. Further, a second planar conductor 4 is disposed so as to cover the top surfaces of the dielectric strip 2, the dielectric resonator 3 and the surrounding member 6*a*. The second planar conductor 4 is made of aluminum or the like in the shape of a flat plate, with two rectangular-shaped openings 4*a* being provided on the dielectric resonator 3 so as to be parallel with respect to the extension axis along the length direction of the dielectric strip 2 and with the line of symmetry of the strip 2.

Figure 3:
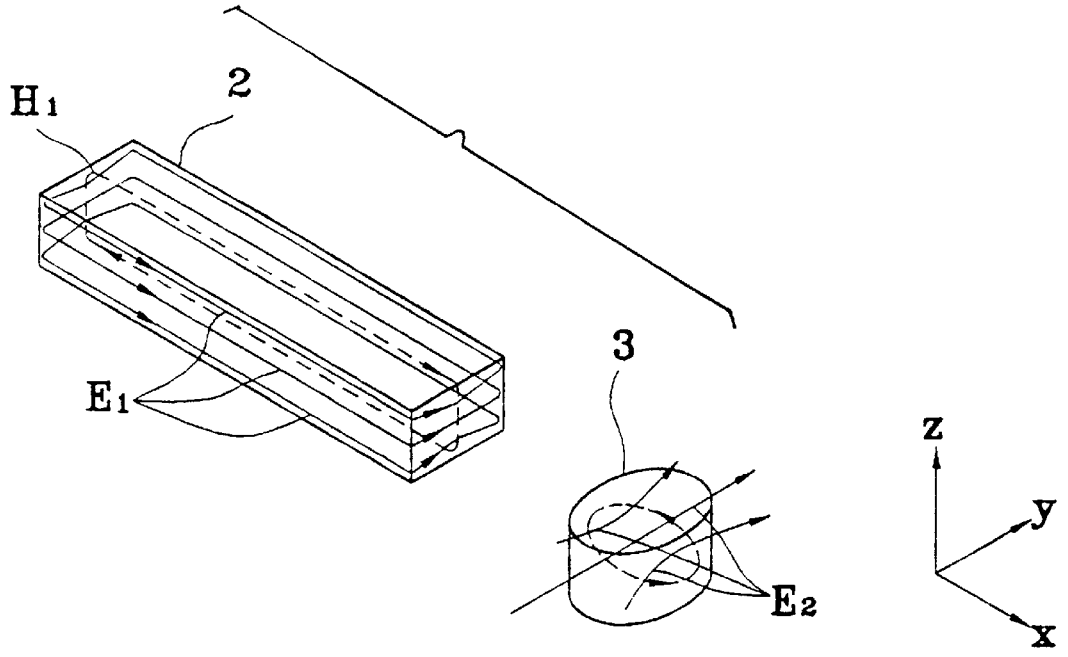
FIG. 3 shows the electric field and the magnetic field in the antenna in accordance with the first embodiment of the present invention.

In the antenna 10 having the above-described structure, the first planar conductor 1, the dielectric strip 2 and the conductor 4 form an NRD guide. Electromagnetic waves transmitted from a waveguide or a transmission circuit (not shown) to the dielectric strip 2, as shown in FIG. 3, propagate inside the dielectric strip 2 in an LSM mode in which an electric field $E_1$ having components at right angles to the length direction (the X-axis direction in FIGS. 1 and 3) of the dielectric strip 2 and horizontal components (the Y-axis direction in FIGS. 1 and 3) with respect to the first planar conductor 1 and the second planar conductor 4, and a magnetic field $H_1$ having components vertical to the second planar conductor 4 are generated. Further, the dielectric strip 2 and the dielectric resonator 3 are electromagnetically coupled to each other, causing an $HE_{111}$ mode having an electric field $E_2$ having components in the same direction as that of the electric field $E_1$ of the dielectric strip 2 to be generated inside the dielectric resonator 3. Hereupon, electromagnetic waves are radiated in the vertical direction (in the Z-axis direction in FIGS. 1 and 3) of the main surface of the second planar conductor 4 from the dielectric resonator 3 via the openings 4*a*. Therefore, in cases where an antenna 5 is mounted in, for example, an automobile, the openings 4*a* are directed in the moving direction of the automobile.

In this antenna 10, the electromagnetic waves transmitted to the dielectric strip 2 are electromagnetically coupled to the dielectric resonator 3 disposed on the extension axis of the dielectric strip 2, and the dielectric resonator 3 radiates, causing electromagnetic waves to radiate mainly in the vertical direction of the antenna 10 from the dielectric resonator 3 via the openings 4*a*.

As described earlier, inside the dielectric resonator 3, there is an electromagnetic wave with symmetrical upper and lower halves having electric field $E_1$ parallel to the first planar conductor 1 and the second planar conductor 4 as main components. However, this symmetry between the upper and lower halves of the electromagnetic waves deteriorates due to the influence of the openings 4*a* provided in the second planar conductor 4, and an electromagnetic field having electric-field components vertical to the first planar conductor 1 and the second planar conductor 4 as main components comes to be intermixed with the above electromagnetic field. Due to the presence of this electromagnetic field having vertical electric-field components, a very small amount of electromagnetic waves are radiated from the side of the dielectric resonator 3 in a direction substantially intersecting at right angles to the length direction in which the dielectric strip 2 is disposed. As a means for preventing this very small amount of electromagnetic wave energy from leaking outside the antenna 10, the surrounding member 6*a* is provided around the dielectric resonator 3.

Figure 4:
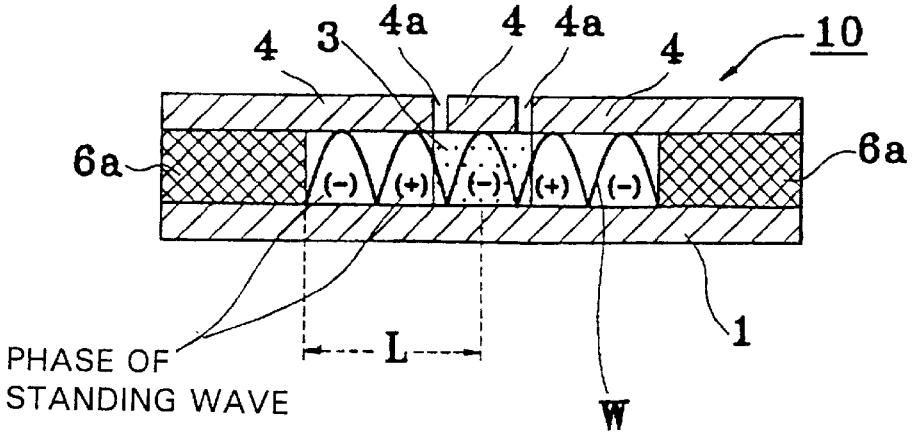
FIG. 4 is a sectional view taken along the line B—B in FIG. 1A.

FIG. 4 is a sectional view taken along the line B—B of the antenna 10 shown in FIG. 1A. Referring to FIG. 4, a description will be given of the relationship between the surrounding member 6*a* and the very small amount of electromagnetic energy which is radiated from the side of the dielectric resonator 3 in a direction substantially intersecting at right angles to the length direction in which the dielectric strip 2 is disposed.

The surrounding member 6*a* is disposed such that when the space between the surrounding member 6*a* and the central portion of the dielectric resonator 3 is denoted as L and the wavelength of the electromagnetic waves radiated from the dielectric resonator 3 is λ, equation (1) described below is satisfied:

$$L=\{(2n+1)/4\}\times\lambda \quad (1)$$

where n is an integer of 0 or more. Whereupon, the surrounding member 6*a* not only prevents the very small amount of electromagnetic energy radiated from the side of the dielectric resonator 3 from leaking outside the antenna 10, but also causes the very small amount of electromagnetic energy to be reflected toward the dielectric resonator 3, with the result that these reflected electromagnetic waves and the very small amount of electromagnetic energy radiated from the side of the dielectric resonator 3 interfere and a standing wave W shown in FIG. 4 is generated. FIG. 4 shows a case in which the space L between the surrounding member 6*a* and the central portion of the dielectric resonator 3 is 5/4λ, which is obtained by substituting, for example, n=2, in equation (1). The electric-field strength of the standing wave W reaches a maximum at the portion where the dielectric resonator 3 is disposed. This standing wave W is electromagnetically coupled to the electromagnetic waves radiated from the top surface of the dielectric resonator 3 via the openings 4*a*, and stronger electromagnetic waves are formed and radiated. As a result, the electromagnetic waves which are transmitted to the dielectric strip 2 can be efficiently radiated from the antenna 10.

In the antenna 10, since the surrounding member 6*a* is hollowed in the shape of a circle around the dielectric resonator 3 as shown in FIG. 2, concerning the distance between the central portion of the dielectric resonator 3 and any point of the surrounding member 6*a*, equation (1) described above is always satisfied. Meanwhile, the very small amount of electromagnetic energy radiated from the side of the dielectric resonator 3 propagates in a direction substantially at right angles to the direction in which the dielectric strip 2 is disposed with respect to the central portion of the dielectric resonator 3. Therefore, the above-described equation need not be satisfied for all the positions of the surrounding member 6*a*, and needs to be satisfied only for the distance to the surrounding member 6*a* positioned in a direction substantially intersecting at right angles to the direction in which the dielectric strip 2 is disposed with respect to the central portion of the dielectric resonator 3.

Figure 5:
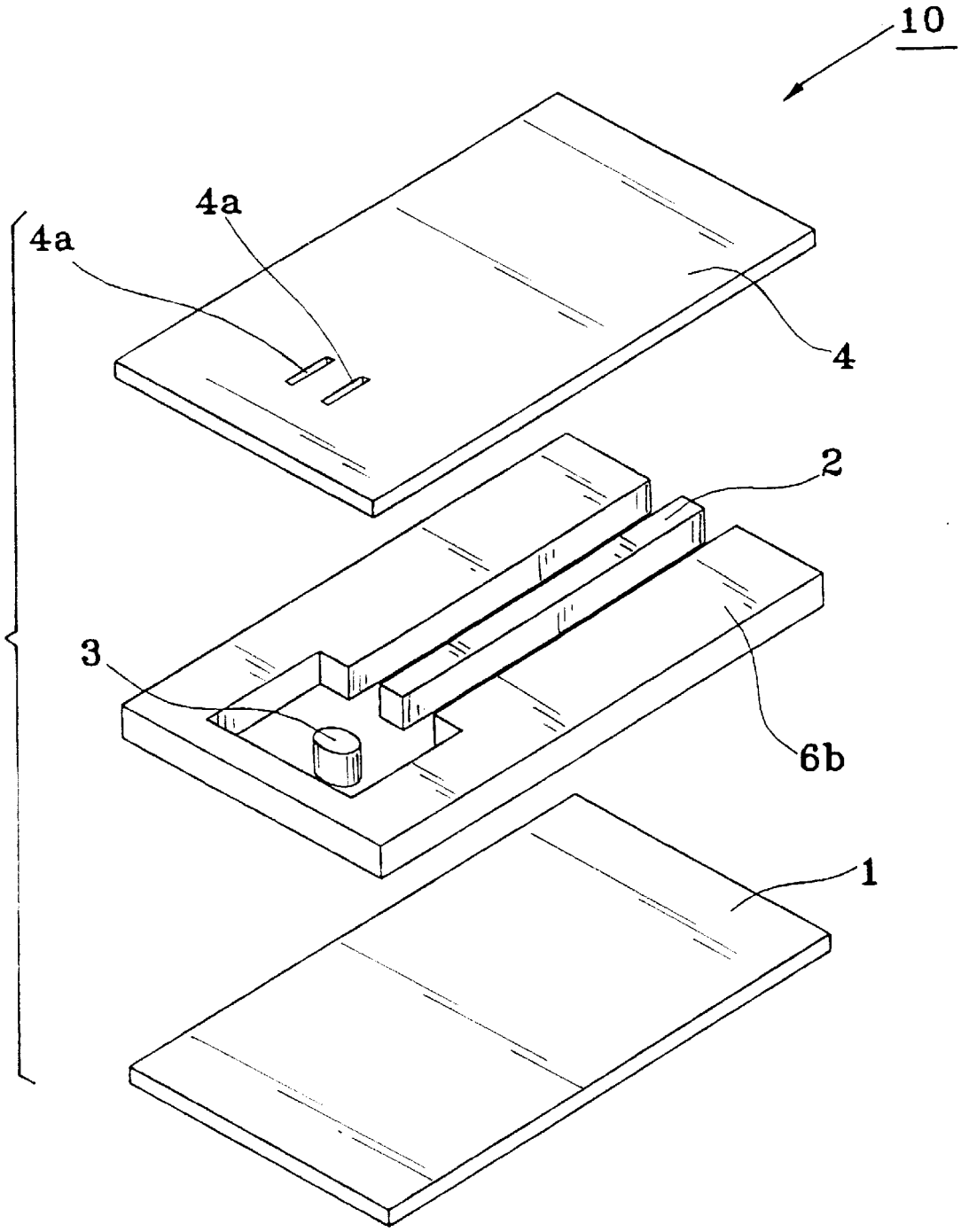
FIG. 5 is an exploded, perspective view illustrating the structure of an antenna in accordance with a second embodiment of the present invention.
Figure 6:
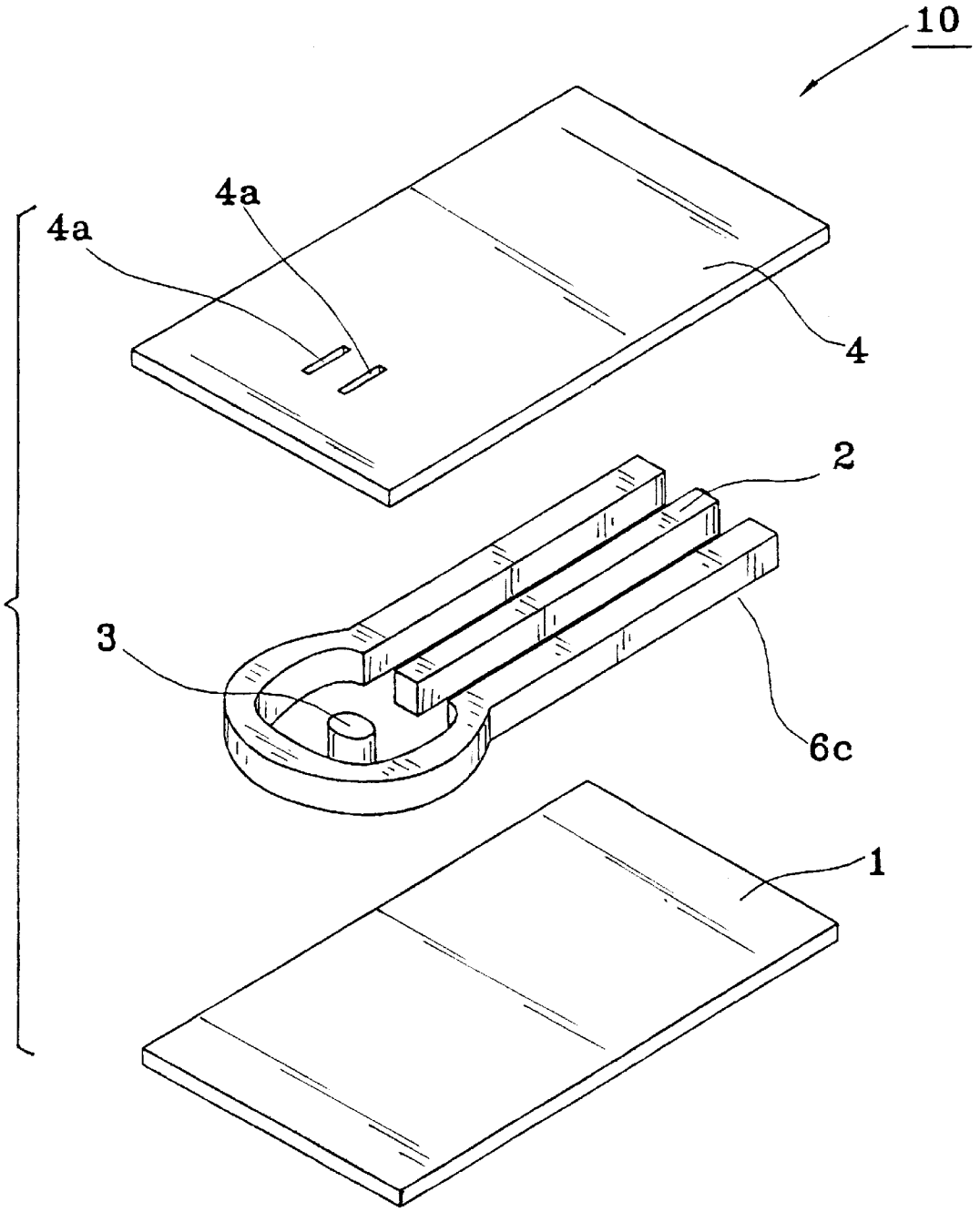
FIG. 6 is an exploded, perspective view illustrating the structure of an antenna in accordance with a third embodiment of the present invention.

Accordingly, examples of other shapes for the surrounding member are shown in FIGS. 5 and 6 as a second and a third embodiment. The antenna shown in the second and third embodiments, as compared with the antenna 10 shown in the first embodiment, differs only in the shape of the surrounding member; therefore, components other than the surrounding member are given the same reference numerals as those of the first embodiment, and thus a description thereof is omitted.

As shown in FIG. 5, in the antenna 10 of the second embodiment, a surrounding member 6*b*, such as a plate made from a metal, such as aluminum, hollowed to a quadrangular shape, is disposed as a surrounding member with a space around the side of the dielectric resonator 3. In addition to the plate-shaped surrounding member, as in the antenna 10 of the third embodiment shown in FIG. 6, a surrounding member 6*c* made of a metallic bar of aluminum or the like machined to a frame shape is disposed around the side of the dielectric resonator 3 with a space therebetween. The shape of the surrounding member is not particularly limited to the shapes shown in the above-described embodiments as long as, as described above, the surrounding member has a structure such that the very small amount of electromagnetic energy radiated from the side of the dielectric resonator 3 does not leak outside and the very small amount of electromagnetic energy is reflected and return towards the dielectric resonator 3. Accordingly, the thickness of the surrounding member is equal to the thickness of the dielectric strip 2 and the dielectric resonator 3, the reflection surface which reflects the electromagnetic energy which leaks is a plane and the reflection surface is vertical to the first planar conductor 1 and the second planar conductor 4.

Further, when the materials of the surrounding members 6*a*, 6*b* and 6*c* are the same as the material of the first planar conductor 1, the first planar conductor 1 and the surrounding members 6*a*, 6*b* and 6*c* may be monolithically formed. As materials for the surrounding members 6*a*, 6*b* and 6*c*, a metal, such as aluminum, is shown in the above-described embodiments. Forming a surrounding member using a metal as described above is effective for reflecting electromagnetic waves.

Although the above-described embodiments are formed by providing two rectangular openings in the second planar conductor in such a manner as to be parallel to each other and with a line symmetry, one rectangular opening may be provided in the dielectric resonator. Further, the shape of the openings is not limited to a rectangular shape, and may be a circular shape. Various changes are possible according to the purposes of use of the antenna.

Though not shown, an antenna formed with another dielectric resonator disposed between the dielectric strip and the dielectric resonator causes two resonances in two dielectric resonators; therefore, a filter effect for spurious radiation, such as secondary higher harmonics, during transmission can be obtained. Further, provision of a plurality of dielectric resonators on the extension axis of the dielectric strip increases the filter effect and achieves a wider band antenna.

Although the first to third embodiments describe a case in which the dielectric resonator 3 is shaped like a column, in addition to the column shape, a prismatic-shaped dielectric resonator may be used.

If the surrounding members 6*a*, 6*b* and 6*c* are disposed in contact with the dielectric strip 2 and/or the dielectric resonator 3, electromagnetic waves are not transmitted from the dielectric strip 2, or the frequency of electromagnetic waves radiated from the dielectric resonator 3 is greatly deviated from an intended frequency. Therefore, the surrounding members 6*a*, 6*b* and 6*c* are disposed with a space to the dielectric strip 2 and the dielectric resonator 3.

Figure 7:
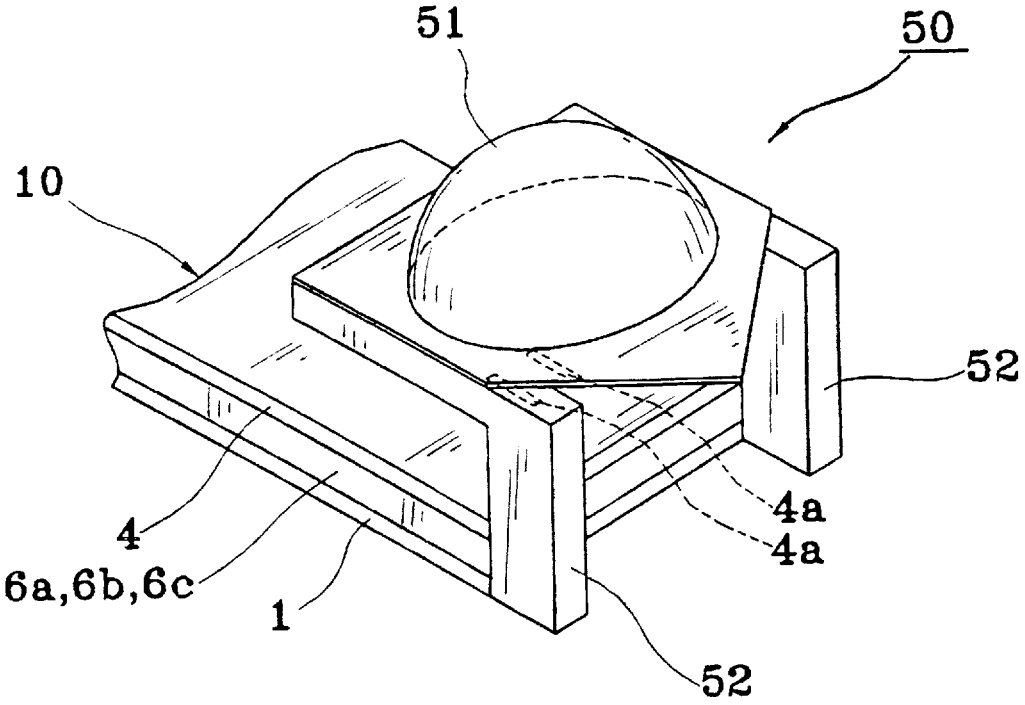
FIG. 7 is a perspective view illustrating the structure of an antenna in accordance with a fourth embodiment of the present invention.
Figure 8:
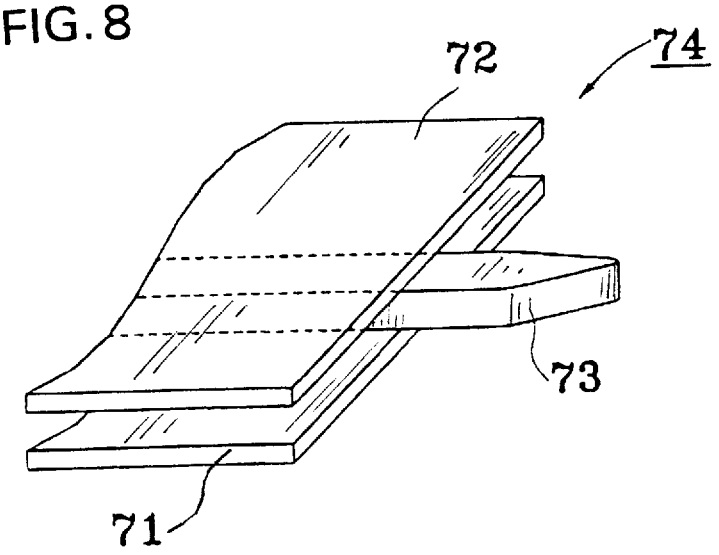
FIG. 8 is a perspective view illustrating the structure of a conventional antenna.
Figure 9:
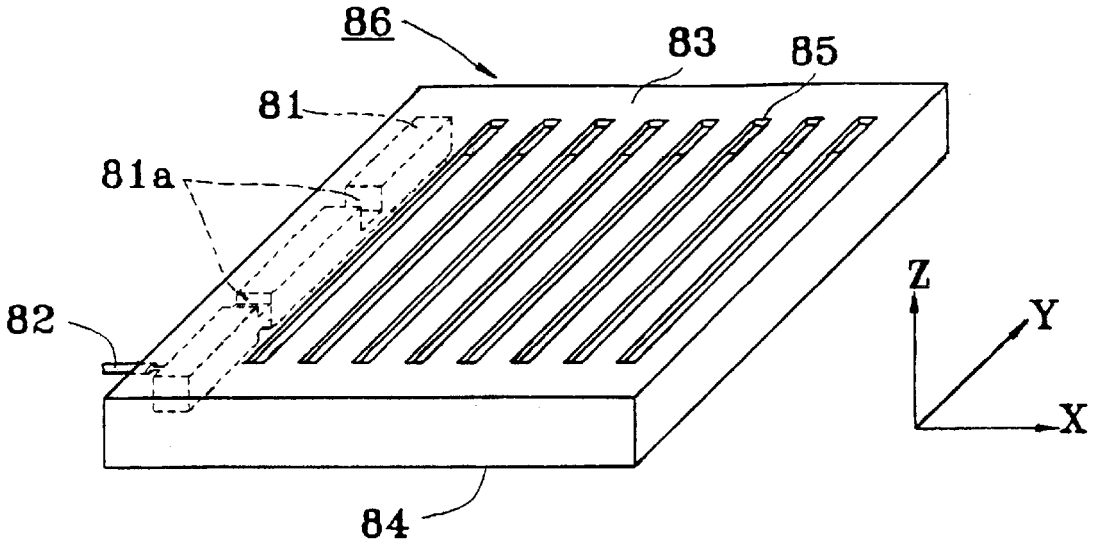
FIG. 9 is a perspective view illustrating the structure of another conventional antenna.

FIG. 7 shows an antenna 50 in accordance with a fourth embodiment of the present invention. As shown in FIG. 7, a dielectric lens 51 is disposed on the top surface of the second planar conductor 4 in the antenna 10 having a structure shown in FIGS. 1 to 6 with a space equal to a focal length at which electromagnetic waves concentrate in correspondence with the openings 4*a*. The dielectric lens 51 may be formed from dielectric materials such as polyethylene, polypropylene, fluororesin or the like. The dielectric lens 51 is fixed onto the top surface of the second planar conductor 4 by a fixation method, such as screwing, using, for example, a fixation material 52 shown in FIG. 6.

The dielectric lens 51 is designed to a predetermined shape beforehand on the basis of the aperture diameter, the focal length, the dielectric constant of the dielectric material, and the like. When, for example, the ratio of the focal length to the aperture diameter is set to 0.3 with respect to an aperture diameter of 80 mm, the focal length becomes 24 mm. Here, the focal length indicates the distance between the flat surface of the dielectric lens 51 and the antenna 10.

At the position of this focal length, electromagnetic waves which enter from the convex surface (the surface of the spherical portion) of the dielectric lens 51 concentrate due to the lens effect. By disposing the antenna 10 at this concentration position, i.e., the focal point, an antenna 50 having a higher gain can easily be formed.

According to the antenna of the present invention as described above, electromagnetic waves transmitted to the dielectric strip are electromagnetically coupled to the dielectric resonator disposed on the extension axis of the dielectric strip, and the dielectric resonator resonates, causing electromagnetic waves to radiate in a vertical direction of the antenna from the dielectric resonator. The electromagnetic waves which leak from the side of the dielectric resonator do not leak outside due to the surrounding member which surrounds the side of the dielectric resonator, and thus no adverse influence is exerted upon other external electronic parts and the like.

Further, by disposing the dielectric resonator and the surrounding member so as to satisfy the equation expressed by $\{(2n+1)/4\}\times\lambda$, electromagnetic energy radiated from the side of the dielectric resonator is reflected by the surrounding member and coupled to the electromagnetic waves radiated from the openings above the dielectric resonator, and thus more strongly radiated electromagnetic waves can be obtained.

Furthermore, by disposing a dielectric lens above the openings provided in the second planar conductor, an antenna having a higher gain can be obtained.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the claims. The following claims are to be accorded the broadest interpretation so as to encompass all such modifications, equivalent structures and functions.

What is claimed is:

1. An antenna comprising:

a first planar conductor;

a dielectric strip having an axis of extension disposed on said first planar conductor;

at least one dielectric resonator disposed on said first planar conductor on the axis of extension of said dielectric strip, the dielectric resonator being spaced from an end of the dielectric strip;

a surrounding member disposed on said first planar conductor surrounding the dielectric resonator, a space being disposed between the surrounding member and the dielectric resonator; and a second planar conductor covering said dielectric strip, said dielectric resonator and said surrounding member and having at least one opening at a portion positioned in the vicinity of the at least one dielectric resonator.

2. The antenna of claim 1, wherein said at least one opening at the portion of the second planar conductor is positioned on said at least one dielectric resonator.

3. The antenna of claim 1, wherein there are two openings at the portion of the second planar conductor positioned in the vicinity of said at least one dielectric resonator.

4. The antenna of claim 3, wherein the two openings at the portion of the second planar conductor are positioned on the dielectric resonator.

5. The antenna of claim 3, wherein the two openings are parallel to the axis of extension and to a line of symmetry of the dielectric strip.

6. The antenna of claim 1, wherein when the wavelength of electromagnetic waves radiated from said dielectric resonator is denoted as $\lambda$, said surrounding member is disposed on said first planar conductor with a space of substantially $\{(2n+1)/4\}\times\lambda$ from a central portion of said dielectric resonator in a direction substantially intersecting at a right angle to the extension axis in which said dielectric strip is disposed, where n is an integer of 0 or more.

7. The antenna of claim 6, wherein a dielectric lens is disposed above the opening of said second planar conductor.

8. The antenna of claim 1, wherein a dielectric lens is disposed above the opening of said second planar conductor.

9. The antenna of claim 8, wherein the dielectric lens comprises at least one of polyethylene, polypropylene and fluororesin.

10. The antenna of claim 1, wherein electromagnetic energy radiating from sides of the dielectric resonator toward the surrounding member are radiated back to the dielectric resonator, creating a standing wave in the space between the dielectric resonator and the surrounding member, the standing wave having a maximum at the dielectric resonator, the maximum being coupled into the opening for radiation.

11. The antenna of claim 1, wherein the space between the surrounding member and the dielectric resonator is substantially rectangular in shape with the dielectric resonator contained therein.

12. The antenna of claim 1, wherein the space between the surrounding member and the dielectric resonator is substantially oval in shape with the dielectric resonator contained therein.

13. The antenna of claim 1, wherein the first conductor, surrounding member and second conductor are made of the same material.

14. The antenna of claim 1, wherein the dielectric resonator comprises a column shaped member.

15. The antenna of claim 1, wherein the dielectric resonator comprises a prismatic shape.

16. The antenna of claim 1, wherein the opening is rectangular in shape.

17. The antenna of claim 1, wherein the opening is circular in shape.

* * * * *